US005313706A

United States Patent [19]

Motta et al.

[11] Patent Number: 5,313,706

[45] Date of Patent: May 24, 1994

[54] RAZOR HEAD WITH VARIABLE SHAVING GEOMETRY

[75] Inventors: Vincent C. Motta, Norwalk; Frank A. Ferraro, Trumbull, both of Conn.

[73] Assignee: Warner-Lambert Company, Morris Plains, N.J.

[21] Appl. No.: 956,527

[22] Filed: Oct. 5, 1992

Related U.S. Application Data

[63] Continuation of Ser. No. 732,293, Jul. 18, 1991, abandoned.

[51] Int. Cl.[5] ..... B26B 21/14

[52] U.S. Cl. ..... 30/57; 30/50; 30/47

[58] Field of Search ..... 30/41.05, 41, 50, 51, 30/57, 58, 77

[56] References Cited

U.S. PATENT DOCUMENTS

| | | | |
|---|---|---|---|
| 3,593,416 | 7/1971 | Edson | 30/50 |
| 4,170,821 | 10/1979 | Booth | 30/41 |
| 4,324,041 | 4/1982 | Trotta | 30/47 |
| 4,335,508 | 6/1982 | Francis et al. | 30/47 |
| 4,442,598 | 4/1984 | Jacobson | 30/50 |
| 4,443,940 | 4/1984 | Francis et al. | 30/50 |
| 4,461,079 | 7/1984 | Ciaffone et al. | 30/79 |
| 4,492,024 | 1/1985 | Jacobson | 30/87 |
| 4,498,235 | 2/1985 | Jacobson | 30/47 |
| 4,516,321 | 5/1985 | Francis | 30/50 |
| 4,574,476 | 3/1986 | Ortiz | 30/47 |
| 4,586,255 | 5/1986 | Jacobson | 30/41 |
| 4,709,477 | 12/1987 | Ferraro | 30/50 |
| 4,774,765 | 10/1988 | Ferraro | 30/50 |
| 4,868,983 | 9/1989 | Francis | 30/50 |
| 4,932,122 | 6/1990 | Shurland et al. | 30/50 |
| 4,932,123 | 6/1990 | Francis | 30/77 |

FOREIGN PATENT DOCUMENTS

| | | |
|---|---|---|
| 0045879 | 2/1982 | European Pat. Off. . |
| 0312663 | 4/1989 | European Pat. Off. . |
| 2457155 | 12/1980 | France . |
| 8303072 | 9/1983 | PCT Int'l Appl. . |
| 8602309 | 4/1986 | PCT Int'l Appl. . |

*Primary Examiner*—Richard K. Seidel
*Assistant Examiner*—Hwei-Siu Payer
*Attorney, Agent, or Firm*—Charles W. Almer, III

[57] ABSTRACT

The present invention is directed to a razor head having at least one blade with a sharpened edge disposed between a guard member and a cap member. The blade is supported in a manner such that the blade is pivotable about a point directly below, or below and forwardly of, the sharpened edge of the blade. The pivoting blade arrangement of the present invention is particularly adapted to decrease the blade exposure while increasing the guard-blade span and the shaving angle when the blade is subjected to forces during shaving. Biasing members are also provided for returning the blade edges to their original position when shaving forces are not acting on the razor head. While the razor head of the present invention is illustrated in a preferred embodiment as a two blade disposable cartridge, alternative embodiments including a single blade and a completely disposable razor are within the scope of the present invention.

18 Claims, 4 Drawing Sheets

RAZOR HEAD WITH VARIABLE SHAVING GEOMETRY

This is a continuation of copending application Ser. No. 07/732,293 filed on Jul. 18, 1991, now abandoned.

The present invention is directed to a razor system and, more particularly, to a razor assembly with variable shaving geometry.

BACKGROUND OF THE INVENTION

The closeness and comfort of a shave is substantially dictated by the relative positions of the skin contacting elements of a razor head. In a typical razor head, the skin contacting elements include a guard member, at least one and preferably two blades, and a cap member. The relative spacing between each of these elements, the angles at which the blades are disposed, their resulting angular displacement with respect to the surface being shaved, and the exposure of the blade edges, relative to a tangent from the guard member to the cap, affect the closeness and comfort of the shave. As used herein the term "seat span" is used to indicate the distance between the edge of the seat blade, i.e. the forward blade, and the closest point on the guard member contacted by a tangent from edge of the seat blade to the guard member. The "cap span" is used to indicate the distance between the edge of the cap blade, i.e. the rear blade, and the point of contact of a tangent line extending from the cap blade edge and the guard blade, typically the edge of the guard blade. The "shave angle" is meant to indicate the angle between a plane extending through the middle and the apex of a blade (exiting the edge) and a tangent between the blade edge and either the guard member for the guard blade, or the seat blade. Lastly, the term "blade exposure" as used herein is intended to mean the perpendicular distance from the edge of a blade to a tangent drawn to both the cap and guard. Those skilled in the art will appreciate that the blade exposure is typically considered positive when the blade edge is disposed above this tangent line and is considered negative when the blade edge is positioned below this tangent line.

In recognition of the fact that surfaces being shaved are not perfectly planar but comprise a large number of contours, it is believed that a more comfortable shave may be obtained by providing a razor with skin engaging elements which are moveable such that their respective distances and angles are adjustable to the surface being shaved in response to shaving forces.

Furthermore, it would be beneficial to provide a razor head with adjustable distances and relative angles of the skin contacting elements and which is relatively simple and inexpensive to manufacture.

As used herein, the term "razor head" is meant to include both razor cartridges adapted to be utilized with a separate handle, as well as the upper, operative elements of a disposable razor to which a handle is permanently attached. For ease of explanation, the present invention is described herein as a disposable cartridge adapted for attachment to a separate handle.

SUMMARY OF THE INVENTION

The present invention is directed to a razor head having at least one blade with a sharpened edge disposed between a guard member and a cap member. The blade is supported in a manner such that the blade is pivotable about a point directly below, or below and forwardly of, the sharpened edge of the blade. The pivoting blade arrangement of the present invention is particularly adapted to decrease the blade exposure while increasing the guard-blade span and the shaving angle when the blade is subjected to forces during shaving. Means are also provided for returning the blade edges to their original position when shaving forces are not acting on the razor head. While the razor head of the present invention is illustrated in a preferred embodiment as a two blade disposable cartridge, alternative embodiments including a single blade and a completely disposable razor are within the scope of the present invention.

DETAILED DESCRIPTION OF THE DRAWINGS

Figure 1:
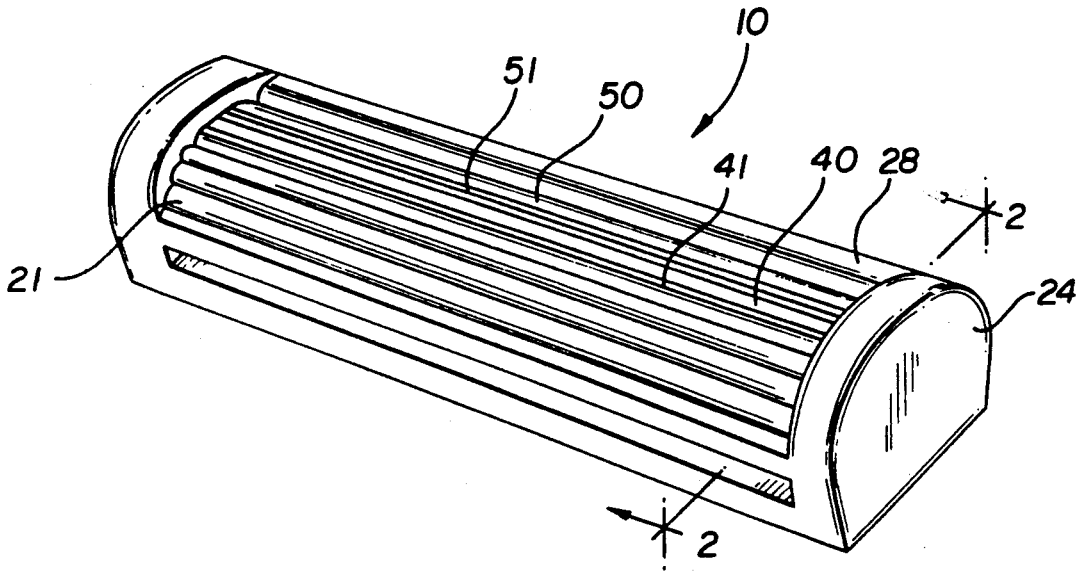
FIG. 1 is a perspective view of one embodiment of the present invention.

As shown in the perspective view of FIG. 1, a razor head 10 of one preferred embodiment of the present invention comprises a guard member 21, a forward blade 40 having a sharpened edge 41, a rear blade 50 having a sharpened edge 51, a cap member 28 supporting a shaving aid 65 (not shown in FIG. 1), and an attachment member 125. In accordance with the illustrated embodiment of the present invention, for ease of manufacturing, the guard member 21, cap member 28 and a sidewall 24 are integrally formed as a single frame 20. Those skilled in the art will appreciate that many thermoplastic materials are particularly suited for forming these elements, for example, by injection molding.

The variable geometry of the razor head of the present invention is provided by a unique arrangement comprising at least one and preferably two blade supports. As a point of reference, when used herein, the term "forwardly" designates the portion of the razor head which contacts a shaving surface first. Thus, for example, the guard member 21 is disposed forwardly of cap member 28.

Figure 6:
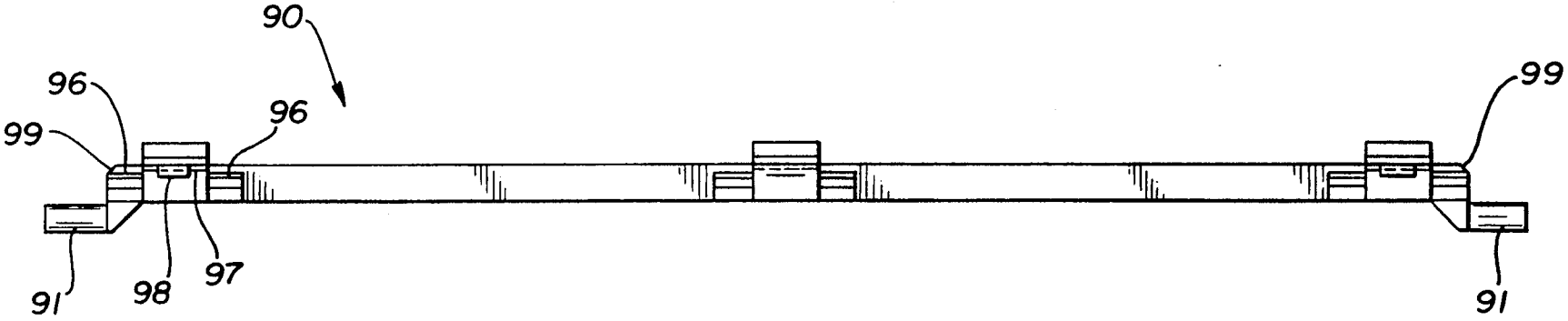
FIG. 6 is a top view of a forward blade support of one embodiment of the present invention.

The blade supports of one preferred embodiment of the present invention are particularly adapted for efficient manufacture and assembly with the other elements of the razor head. As illustrated in FIGS. 2, 3 and 6–8, the illustrated blade support 90 is formed with cylindrical journal members 91 at both ends thereof for pivotally connecting the blade support 90 to the sidewalls 24 of the frame. The blade support 90 also comprises attachment members 95 disposed on the upper portion thereof for securing a blade 40 to the pivotably mounted blade support 90. While the illustrated embodiment of FIG. 6 shows three attachment members on this forward blade support 90, those skilled in the art will appreciate that fewer or a greater number of attachment members may also be utilized without departing from the scope of the present invention.

As best shown in FIG. 6, the illustrated attachment members 95 each comprise three upwardly extending blade retainers. The retainers are each provided with a substantially vertical face and are positioned such that the vertical faces of the forwardly disposed retainers 96 face rearwardly while the vertical faces of the rearwardly positioned retainer 97 face forwardly. The retainers are positioned such that a small space is provided between the respective vertical faces of the forward retainers 96 and rearward retainers 97 in order to provide clearance for the base 45 of a blade 40.

Figure 10:
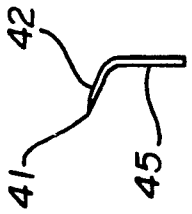
FIGS. 9 and 10 are top and side views, respectively of a blade of one embodiment of the present invention.
Figure 7:
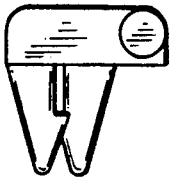
FIG. 7 is a side view of the forward blade support illustrated in FIG. 6.
Figure 9:
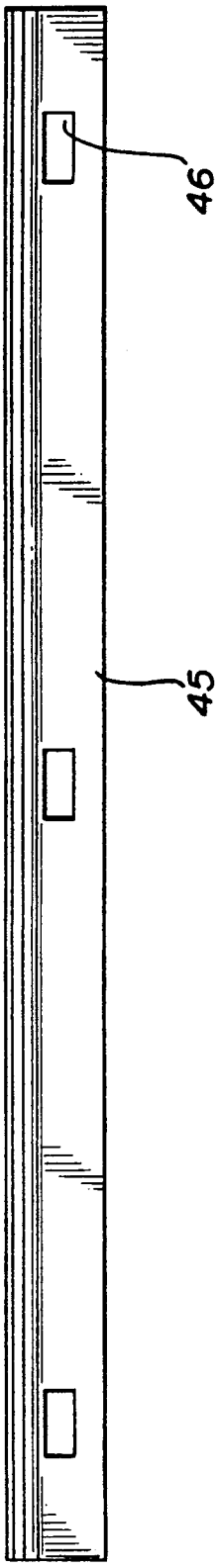

FIGS. 9 and 10 illustrate a blade 40 of one embodiment of the present invention. The blade is advantageously provided with a base portion 45 and an upper cutting portion 42 having a sharpened edge 41. In the illustrated embodiment of the present invention, the blade 40 is formed as a single element and therefore does not require spot welding or other additional fasteners, such as stakes, utilized in some razors of the prior art for securing a sharpened edge to a blade support. However, those skilled in the art will appreciate that alternative blade designs may be utilized without departing from the scope of the present invention.

In the illustrated embodiment, the rearward blade retainers 97 are also provided with a protruding lip 98, best shown in FIG. 6, which passes through a hole 46 in the base 45 of a blade 40 thereby securing the blade 40 to the blade support 90. In order to facilitate placement of the blade in the gap formed between the forwardly and rearwardly positioned blade retainers, the upper inner portions of the retainers are angled inwardly in order to guide the base 45 of the blade 40 downwardly into the gap between the retainers.

Those skilled in the art will appreciate that blade supports 90 may be formed of any suitable material such as plastic or metal. Since the movement of the blades of the present invention is provided by the pivotal attachment between the journals 91 of the blade supports 90 and the sidewalls 24, the blade supports may be formed of any fairly rigid thermoplastic material such as those as commonly used in injection molding.

Figure 8:
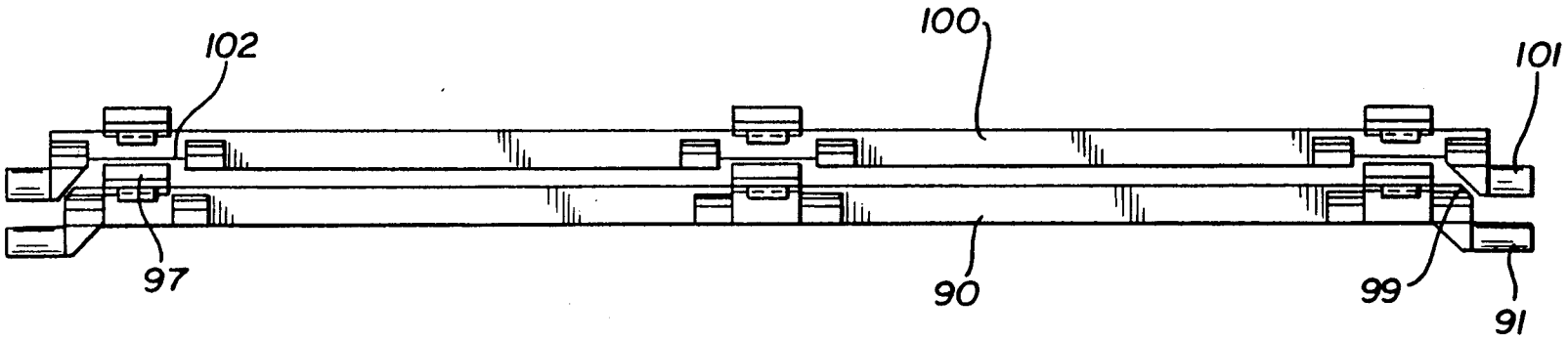
FIG. 8 is a top view of two blade supports of a preferred embodiment of the present invention.

In the illustrated two blade embodiment of the present invention, the rearward blade support 100 is very similar to the forward blade support 90, as illustrated in FIG. 8. The only difference between the two illustrated blade supports, is that the rearward blade support 100 has relieved sections 102 and a greater distance between the forwardly positioned retainers in order to provide room for the independent, pivotal movement of portions of the forward blade support 90, particularly the rearwardly positioned retainers 97 of the forward blade support 90. Additionally, in this embodiment of the present invention, the rear corners 99 of the forward blade support are preferably tapered. Those skilled in the art will appreciate that these minor design modifications are utilized in this illustrated embodiment in order to provide sufficient clearance for the independent, pivotable movement of the two blade supports.

Figure 4:
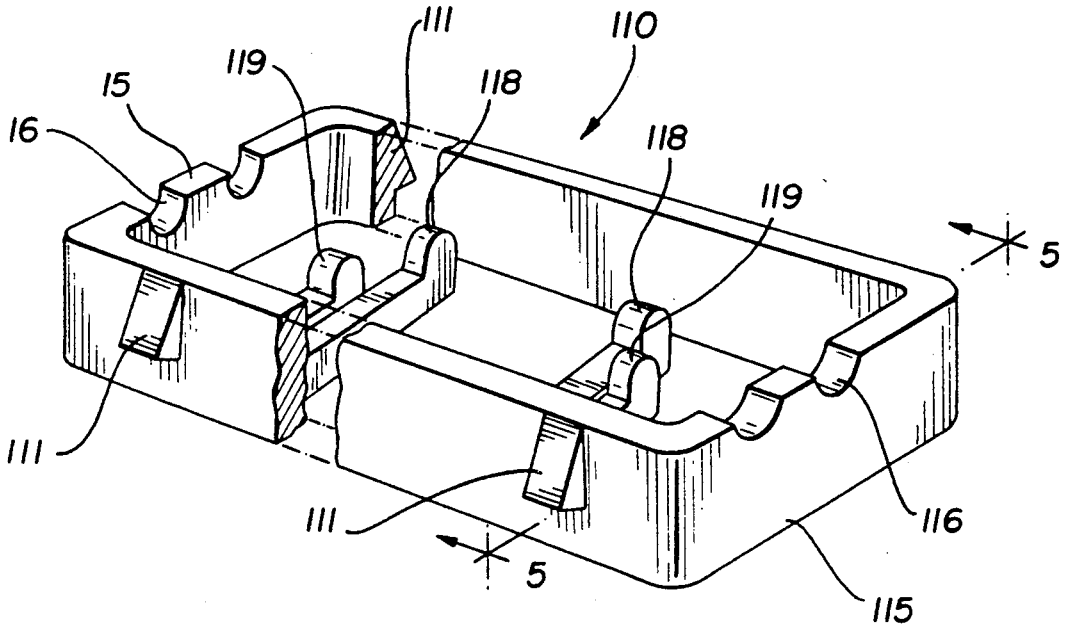
FIG. 4 is a partial perspective view of the base member of one embodiment of the present invention.
Figure 5:
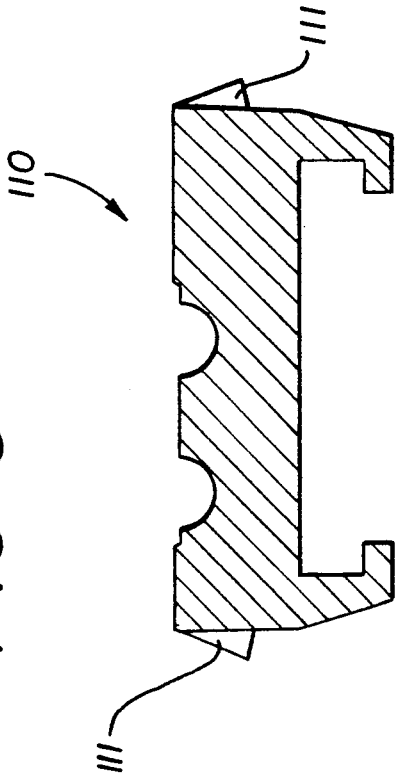
FIG. 5 is a cross-sectional view of the base member taken along lines 5—5 of FIG. 4.

According to the illustrated embodiment of the present invention, the blade supports are secured within the frame 20 by base member 110 which is adapted to be snap fit into the bottom of the frame 20. Base member 110 is illustrated in FIGS. 4 and 5 as having a plurality of locking tabs 111 and attachment members 125. Locking tabs 111 are simply wedge-shaped protrusions extending outwardly from the forward and rearward sides of base member 110 adapted to provide locking engagement with lower lips 22 of the frame member 20. From the cross sectional view of FIGS. 2 and 3, it will be appreciated that base member 110 is adapted to the readily snapped into the bottom of the frame member 20 during assembly.

Base member 110 also advantageously comprises a plurality of substantially semi-circular notches 116 disposed in the sidewalls 115 of the base member 110. During assembly, the frame 20 is inverted, blade supports 90 are placed within the frame such that each journal 91 is disposed within a semi-circular groove 116 located on the internal portion of sidewall 24 of the frame 20, and then the base member 110 is snap fit into the bottom of the frame 20 thereby securing journal member 91 between the interior portions of sidewall 24 of frame 20 and the grooves 116 of base member 110.

Figure 2:
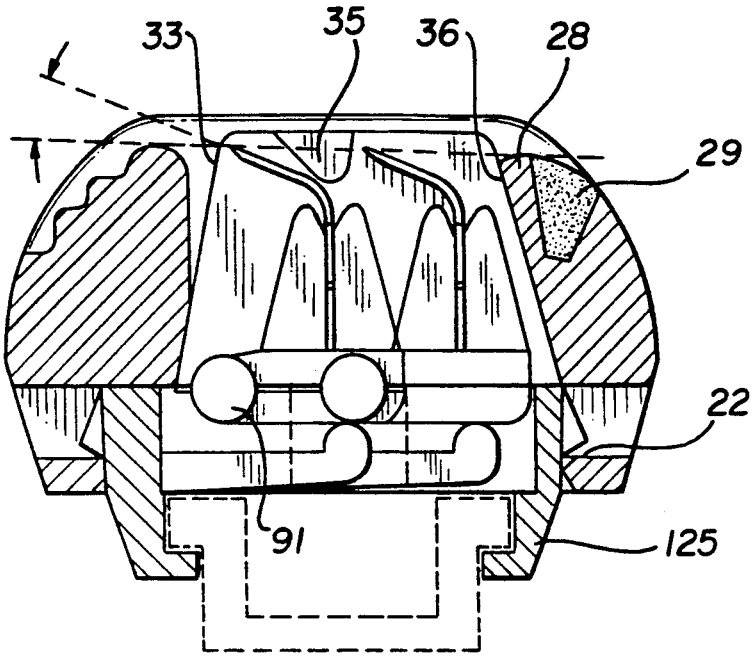
FIGS. 2 and 3 are cross-sectional views taken along lines 2—2 of the razor head shown in FIG. 1 in "normal" and biased configurations, respectively.
Figure 3:
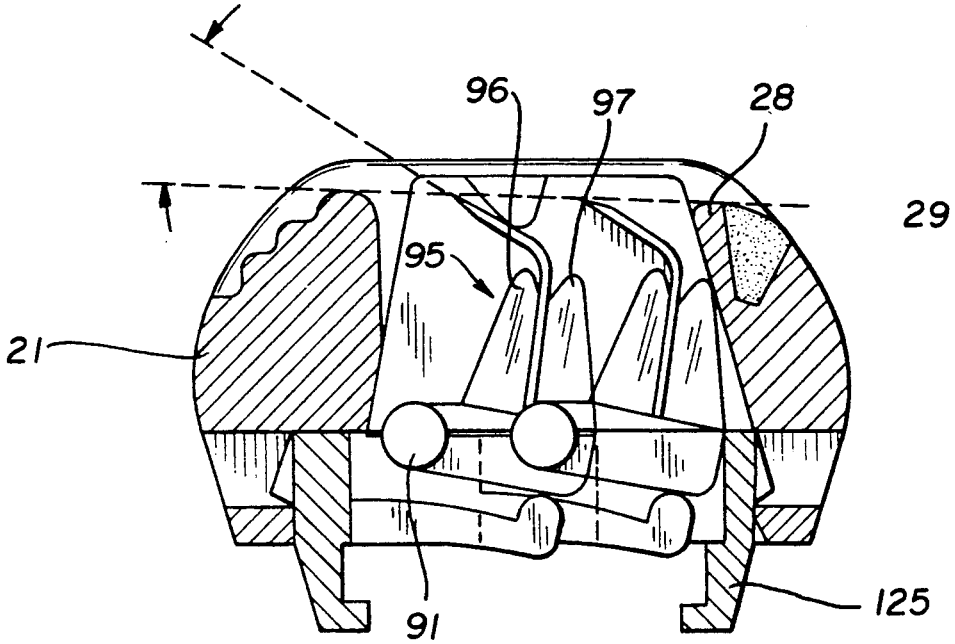

As best shown in the cross sectional view of FIGS. 2 and 3, the interior of sidewall 24 is provided with a recess having a front wall 33, a stop 35 and a rear wall 36. While not illustrated in the figures, the inner sidewalls of frame member 20 are symmetrical. When the blade supports are in their normal position, i.e. when the blades are not acted upon by forces such as the forces encountered during shaving, an end portion of the blade edge 41 contacts forward wall 33. In this manner, forward wall 33 limits the forward movement of the forward blade 40. In a similar fashion, the forward rotation of rear blade 50 is limited by the stop 35 which contacts a small portion of the cutting edge 51 of cap blade 50. The generally tapered shape of front wall 33 and rear wall 36 also facilitate assembly of the illustrated embodiment of the present invention.

As illustrated, base member 110 also comprises a plurality of spring fingers 118, 119 for normally biasing blade supports 90 to a forward position. FIG. 2 illustrates blade supports 90 in their normal, forward position. When the blade edges are subjected to forces during shaving, either singularly or collectively, blade supports are designed to rotate about a longitudinal axis passing substantially through the center of journal members 91 and 101 in the manner illustrated in FIG. 3. This rotation lowers the rearward portions of the blade supports and thereby biases spring fingers 118, 119 downwardly. As illustrated in FIG. 3, the rearward rotation of the forward blade 40 and rear blade 50 is limited by stop 35 and rear wall 36, respectively.

As shown in FIG. 4, spring fingers are preferably integrally formed with base member 110 and are formed of a material having sufficient resilience such that they can continue to urge the blade supports into their upper position for the useful life of the razor head.

Those skilled in the art will appreciate that other designs may be provided for urging blade supports, and consequently the blade edges, into their upper, normal positions without departing from the scope of the present invention.

Though the pivoting axis of each of the blade supports is illustrated as being substantially directly below the respective blade edges, according to an alternative embodiment of the present invention the pivoting axis may be disposed below and forwardly of the respective blade edges. Such positioning of the pivoting axis, in conjunction with the various blade limiting structures, i.e. front wall 33, stop 35 and rear wall 36 of frame 20, ensure that the blade spans and the blade angles do not decrease and that the exposures do not increase relative to their normal positions.

According to the illustrated embodiment of the present invention, a shaving aid 29 is advantageously attached to cap member 28. It will be appreciated by those skilled in the art that the shaving aid can be incorporated by several different methods including attaching the shaving aid to or embedding the shaving aid in a portion of the razor head, for example, the cap 28.

Exemplary materials constituting the shaving aid may comprise one or various combinations of the following:

A. A lubricating agent for reducing the frictional forces between the razor head and the skin, e.g. a microencapsulated silicone oil.

B. An agent which reduces the drag between the razor parts and the shaver's face, e.g., a polyethylene oxide in the range of molecular weights between 100,000 and 6,000,000; a non-ionic polyacrylamide; and/or a natural polysaccharide derived from plant materials such as "guar gum".

C. An agent which modifies the chemical structure of the hair to allow the razor blade to pass through the whiskers very easily, e.g., a depilatory agent is one example.

D. A cleaning agent which allows the whisker and skin debris to be washed more easily from the razor parts during shaving, e.g., a silicone polyethylene oxide block copolymer and detergent such as sodium lauryl sulphate.

E. A medical agent for killing bacteria, or repairing skin damage and abrasions.

F. A cosmetic agent for softening, smoothing, conditioning or improving the skin.

G. A blood coagulant or an astringent for the suppression of bleeding that occurs from nicks and cuts.

As mentioned above, the configuration of the shaving aid, its place of application to the razor head, the manner of attachment and/or other means and method of incorporation may vary widely to fit particular requirements. For example, instead of attaching the shaving aid to the cap, the shaving aid may be disposed on or in the guard member 21.

The elements of the present invention can be formed of materials known in the art. It is preferred to utilize thermoplastic material having high levels of structural integrity. A particularly suitable material is one which is made out of a segmented copolyester elastomer which contains recurring polymeric long chained ester units, derived from dicarboxylic acids and long chain diols and short chain ester units derived from dicarboxylic acids and low molecular weight diols. Suitable materials particularly favored for construction of the cap and seat portions are described in the U.S. Pat. Nos. 3,766,146 and 3,651,014 to Witsiepe assigned to E. I. du Pont de Nemours and sold under the tradenames HYTREL 5556 and HYTREL 4056, respectively.

Those skilled in the art will appreciate that alternative embodiments of the present invention may include elements having different configurations than those illustrated in the drawings. For example, one or both of the guard and cap members may be slotted, i.e. formed of a number of smaller guard or cap segments with spaces provided between those segments.

Both blade spans, blade angles, and blade exposures, as described above, may be initially set at any desired position without departing from the scope of the present invention. For example, a razor head of the present invention may be designed such that the seat blade spans have a range of about 0.020–0.080 inches from a normal position to a position of maximum rotation. Similarly, the blade exposure may range from about +0.005 to (−) 0.005 inches and the rotation of the blade may be set such that the angle ranges from about 15° to about 35°.

While each blade is illustrated as an integrally formed, single piece, alternative blade shapes may be utilized without departing from the scope of the present invention. For example, the blade support may be extended upwardly further then the blade supports illustrated in FIGS. 2 and 3 and the blades may be secured to those blade supports by staking, spot welding, or other methods well known in the shaving industry.

When the razor head of the present invention is formed as a disposable cartridge, the bottom portion of the razor head is provided with means for attaching the cartridge to a razor handle. The particular attachment mechanism utilized with the present invention may take many forms, including those well known in the shaver industry. For example, the attachment mechanism may comprise a simple track adapted to receive a rigid rail mounted on the distal end of a razor handle as shown in the illustrated embodiment. Alternatively, the attachment mechanism may comprise a pivotal mechanism or other arrangement such as those well known in the shaving industry.

We claim:

1. A razor head comprising:

a base member;

a forwardly positioned guard member secured to said base member;

at least one blade having a sharpened edge;

said base member comprising means for supporting said blade such that said blade is pivotally supported from a normal position about an axis disposed directly below said edge, wherein said blade is movable from said normal position in response to forces encountered during shaving; and means for biasing said supporting means to said normal position, said biasing means operatively connected to said supporting means for returning said edge to said normal position;

wherein said razor head comprises a frame and said supporting means comprises a blade support for each blade, said blade support having;

an attachment section adapted to receive said blade; and a connecting portion disposed at an angle to said attachment section, said connecting portion adapted for pivotably securing said blade support with said frame;

wherein said blade comprises at least one aperture; and said attachment section comprises a pair of opposed, resilient members and at least on of said opposed, resilient members comprises a protrusion which extends into said aperture of said blade.

2. A razor head according to claim 1 comprising two blades.

3. A razor head according to claim 1 wherein said biasing means comprises a plurality of spring fingers.

4. A razor head according to claim 3 wherein said spring fingers are integrally formed with said base member.

5. A razor head according to claim 4 further comprising a cap member disposed rearwardly of said blade and a shaving aid disposed on at least one of said guard member or said cap member.

6. A razor blade according to claim 5 comprising a shaving aid disposed on said cap member.

7. A razor head according to claim 1 wherein said blade comprises at least one attachment hole and said supporting means comprises means for securing said blade to said supporting means wherein said securing means extends through said attachment hole.

8. A razor head according to claim 1 comprising means connected to said base member for stopping forward rotation of said supporting means beyond said normal position.

9. A razor head comprising:

a blade support structure having a rearwardly disposed cap member and a forwardly disposed guard member;

a blade having a sharpened edge;

means for supporting said blade for pivotal rotation from a normal position to at least one position other than said normal position, said supporting means connected to said blade support structure and pivoting about an axis disposed in a region extending from an area directly below said blade edge to an area below and forwardly of said blade edge;

a blade retainer disposed on the supporting means wherein said blade is affixed to said blade retainer; and means for biasing said supporting means to said normal position wherein said biasing means are connected to said blade support structure;

wherein said supporting means comprise a cylindrical member connected to said blade support structure.

10. A razor head according to claim 9 wherein said biasing means comprises a plurality of spring fingers.

11. A razor head according to claim 9 wherein said blade comprises at least one attachment hole and said supporting means comprises means for securing said blade to said supporting means wherein said securing means extends through said attachment hole.

12. A razor head according to claim 9 comprising means connected to said support structure for stopping forward rotation of said supporting means beyond said normal position.

13. A razor head comprising:

a blade support structure having a rearwardly disposed cap member and a forwardly disposed guard member;

a blade having a sharpened edge;

means for supporting said blade for pivotal rotation from a normal position to at least one position other than said normal position, said supporting means connected to said blade support structure and pivoting about an axis disposed in a region extending from an area directly below said blade edge to an area below and forwardly of said blade edge;

a blade retainer disposed on the supporting means wherein said blade is affixed to said blade retainer;

means for biasing said supporting means to said normal position wherein said biasing means are connected to said blade support structure;

wherein said supporting means comprise a cylindrical member connected to said blade support structure; and wherein said cap member and said guard member are integrally formed as portions of a frame which is adapted to receive a base member comprising said biasing means.

14. A razor head according to claim 13 wherein said biasing means comprises a plurality of spring fingers.

15. A razor head according to claim 14 comprising means connected to said support structure for stopping forward rotation of said supporting means beyond said normal position.

16. A razor head according to claim 14 wherein said spring fingers are internally formed with said base member.

17. A razor head according to claim 16 wherein said blade comprises at least one attachment hole and said supporting means comprises means for securing said blade to said supporting means wherein said securing means extends into said attachment hole.

18. A razor head comprising:

a base member;

a forwardly positioned guard member secured to said base member;

at least one blade having a sharpened edge;

at least one blade retainer wherein said blade is affixed to said blade retainer;

a dynamic support system connected to said base member, wherein said dynamic support system comprises means for supporting said blade such that said blade is pivotal from a normal position, about an axis disposed in a region extending directly below said blade edge to an area below and forwardly of said blade edge; and means for biasing said supporting means to said normal position;

wherein said means for supporting said blade includes at least one cylindrical support member which supports the at lest one blade retainer and said cylindrical support member pivots to cause the blade to move along a predetermined arcuate path in response to forces exerted on said razor head during shaving.

* * * * *